US007272901B2

(12) United States Patent
Jewitt

(10) Patent No.: US 7,272,901 B2
(45) Date of Patent: Sep. 25, 2007

(54) DISPLAY ARRANGEMENT

(75) Inventor: Richard Laurence Jewitt, Bath (GB)

(73) Assignee: Allcloud Ltd., Canterbury, Kent (GB)

( * ) Notice: Subject to any disclaimer, the term of this patent is extended or adjusted under 35 U.S.C. 154(b) by 242 days.

(21) Appl. No.: 11/098,957

(22) Filed: Apr. 4, 2005

(65) Prior Publication Data

US 2005/0223605 A1 Oct. 13, 2005

(30) Foreign Application Priority Data

Apr. 7, 2004 (GB) ..... 0407866.3

(51) Int. Cl.
*G09F 11/00* (2006.01)

(52) U.S. Cl. ..... 40/491; 40/445; 434/368

(58) Field of Classification Search ..... 40/491, 40/488, 490, 446, 453, 445, 427; 434/405, 434/176, 199, 348; 446/151; 472/57, 59, 472/71, 72

See application file for complete search history.

(56) References Cited

U.S. PATENT DOCUMENTS

| | | | | | |
|---|---|---|---|---|---|
| 733,819 | A * | 7/1903 | Demmon | 40/445 |
| 2,133,155 | A * | 10/1938 | Stevens | 40/446 |
| 2,485,806 | A * | 10/1949 | Berg | 40/488 |
| 2,833,066 | A * | 5/1958 | Morrissey | 40/491 |
| 2,961,788 | A * | 11/1960 | Halperin | 40/446 |
| 3,102,350 | A * | 9/1963 | Dixon | 40/491 |
| 3,848,348 | A * | 11/1974 | Hawley | 40/491 |
| 4,809,453 | A * | 3/1989 | Morgan | 40/488 |
| 4,837,957 | A * | 6/1989 | Egender | 40/488 |
| 6,807,759 | B1 * | 10/2004 | Burder | 40/453 |
| 7,007,365 | B2 * | 3/2006 | Vanderburg | 29/434 |

FOREIGN PATENT DOCUMENTS

| | | |
|---|---|---|
| DE | 29610847 | 10/1996 |
| DE | 10209360 | 10/2003 |
| FR | 2717422 | 9/1995 |
| GB | 2336567 | 10/1999 |

* cited by examiner

*Primary Examiner*—Lesley D. Morris
*Assistant Examiner*—Shin Kim
(74) *Attorney, Agent, or Firm*—Smith-Hill and Bedell

(57) ABSTRACT

A display arrangement 10 made of card with a pair of windows 18. A movable carrying member 30 is provided bearing two images 30 selectively viewable through the respective windows 18. The arrangement 10 is configured such that a one of the images 38 is viewable through a respective window 18 when the carrying member 30 is moved in a first direction, and the other image 30 is viewable through the other window 18 when the carrying member is moved back in the opposite direction.

14 Claims, 3 Drawing Sheets

DISPLAY ARRANGEMENT

This application claims priority under 35 USC 119 of United Kingdom Patent Application No. 0407866.3 filed Apr. 7, 2004.

This invention concerns a display arrangement, and particularly but not exclusively an arrangement which can be incorporated in a book, and especially a childrens book.

There is a continuing desire and requirement, and especially in childrens books, to provide novel features which attract and retain a child's attention, and which also aid enjoyment of the book.

According to the present invention there is provided a display arrangement, the arrangement including a frame member defining a window, a carrying member including an image bearing part, the carrying member being movable relative to the frame member such that said image can be moved past the window to be visible therethrough, and a shield member, the shield member being arranged such that if the image bearing part is moved past the window in a first direction the image can be seen through the window, but if the image bearing part is moved past the window in an opposite direction, the image is obscured by the shield member and cannot be seen through the window.

The arrangement may be configured such that when moving in the first direction the image bearing part passes between the shield member and the window, and when moving in the opposite direction the image bearing part passes on the opposite side of the shield member to the window.

Inclined flaps may be provided on opposite leading edges of the shield member, which flaps are configured to direct the image bearing part of the carrying member between the shield member and the window when reaching the shield member moving in the first direction, and to direct the image bearing part of the carrying member on the opposite side of the shield member to the window when reaching the shield member moving in the opposite direction.

The carrying member may include a tab which is manually engageable to enable a person to move the carrying member relative to the frame member.

The carrying member may be slidably movable relative to the frame member.

In an alternative arrangement the carrying member may be rotatably movable relative to the frame member.

The display arrangement may be in the form of a page of a book, and the frame member may form one face of the page.

The display arrangement may comprise a plurality of components made from a substantially planar material, which material may be card.

Spacer means may be provided between the carrying member and the frame member to permit the image bearing part to move or flex to pass respectively either side of the shield member.

Guide means may be provided between the carrying member and the frame member to guide the movement of the carrying member relative to the frame member.

The frame member may include a pair of windows, the carrying member may include two image bearing parts each bearing a respective image, and each viewable through a respective one of the windows when moving in a first direction.

The arrangement may be configured such that one image is viewable through one of the windows when a carrying member moves a respective image carrying part past the shield member in one direction, and the other image is viewable through the other window when the respective image carrying part is moved past the shield member in a reverse direction.

The two images on the respective image bearing parts may be identical to provide an illusion of the image moving between the windows.

Alternatively, one of the images may be an altered version of the other to provide an illusion of the image being altered between the windows.

As a further alternative, two different images may be provided.

The arrangement could include a second frame member with a window or windows, with the second frame member on an opposite side of the shield member to the first frame member, a further image or images being provided on the opposite side of the image bearing part or parts of the carrier member, with the further image or images viewable through the respective window or windows of the second frame member when the image bearing part or parts is moved passed said respective window or windows in said opposite direction.

An embodiment of the present invention will now be described by way of example only and with reference to the accompanying drawings, in which:—

Figure 1:
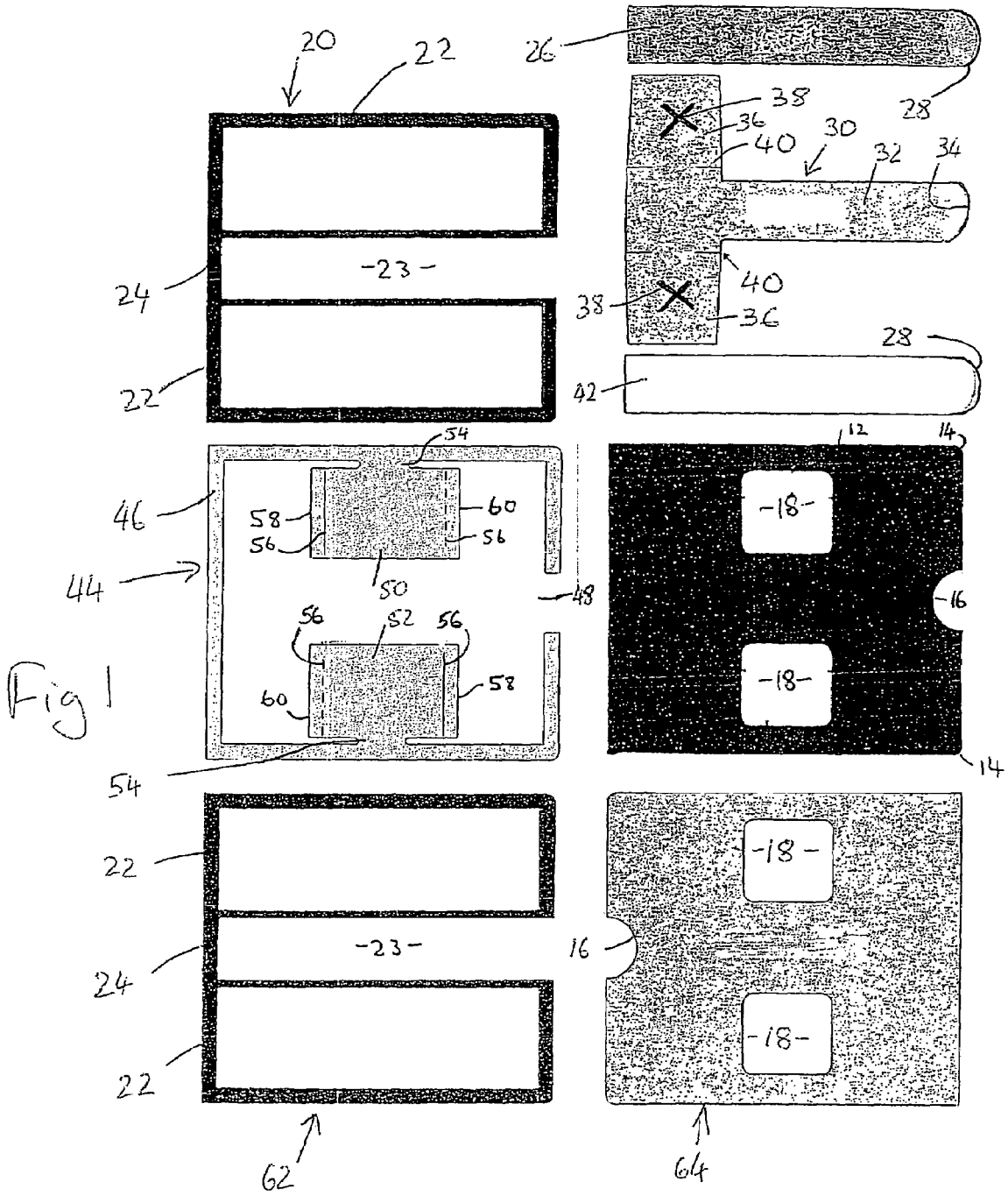
FIG. 1 is a diagrammatic plan view of components of a display arrangement according to the invention.
Figure 2:
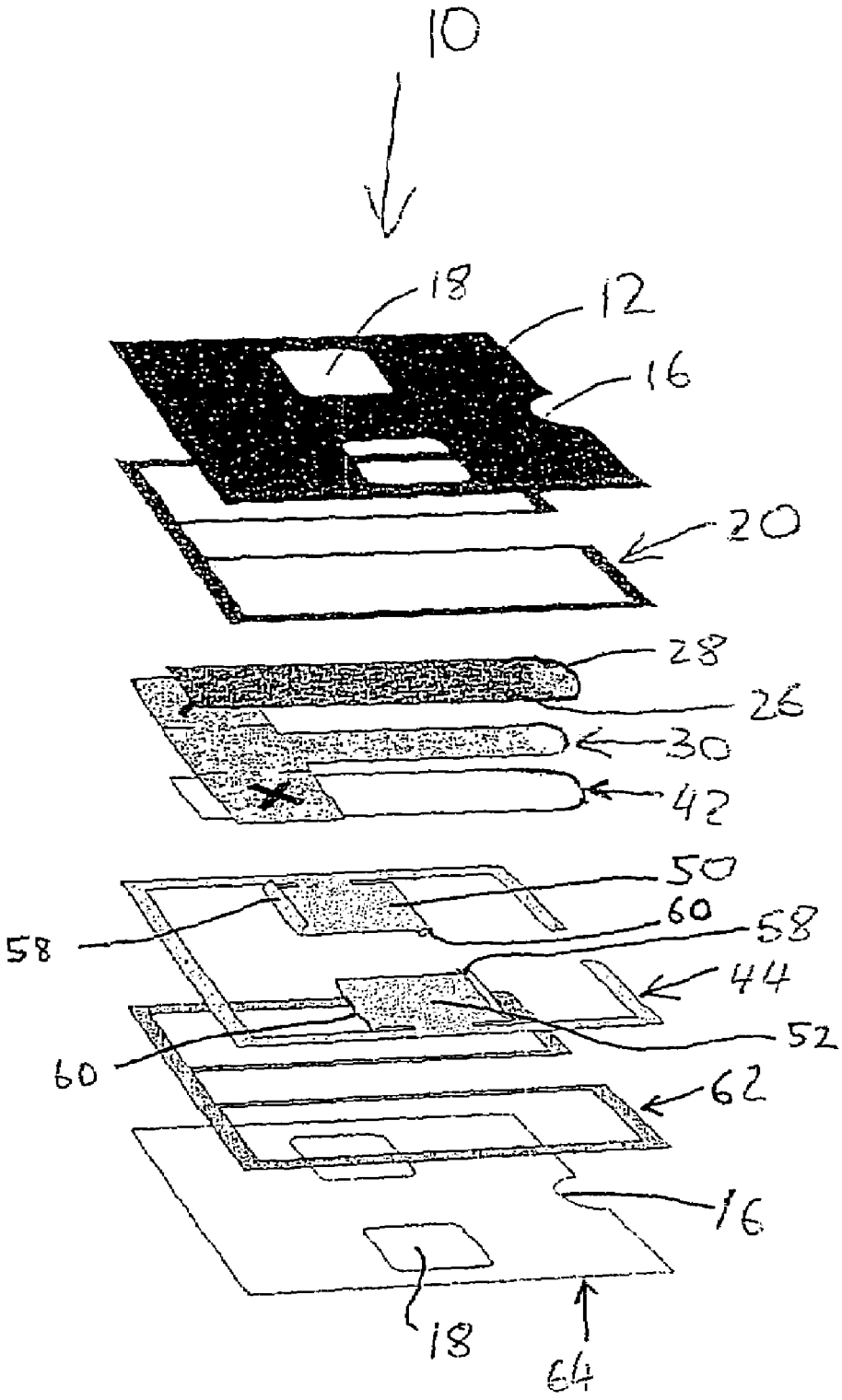
FIG. 2 is a diagrammatic perspective exploded view illustrating how the components of FIG. 1 are assembled in the arrangement.

The drawings show a display arrangement 10 which could be in the form of a page of a childrens board book. The arrangement 10 includes the following components which will be described in order from the topmost component when assembled, as shown in FIG. 2. All of the components are made of card. A first frame member 12 is provided which is generally rectangular and has rounded upper and lower right hand corners 14 as shown in FIG. 1, as is conventional in board books. A semi-circular recess 16 is provided centrally in the right hand edge of the member 12. A pair of windows 18 are provided one above each other and respectively above and below the recess 16 generally midway between the left and right hand edges of the member 12. The windows 18 are rectangular and have rounded corners.

The arrangement 10 includes spacing means in the form of a first support member 20, which is provided with upper and lower rectangular frame sections 22 joined by a web 24 on the left hand side as shown in FIGS. 1 and 2. The support member 20 is formed from triple thickness card, or three sheets of card mounted together.

A first guide member 26 is provided in the form of a rectangular strip of a size to fit in a gap 23 defined between the rectangular frame sections 22 of the first support member 20. The first guide member 26 has a convex right hand end 28 and is made of double thickness card, or two laminated sheets of card.

A carrying member 30 of single thickness card is provided. The member 30 includes a rectangular strip 32 of similar dimensions to the guide member 26, with a convex end 34 which provides a tab. Two image bearing parts 36 extend laterally (above and below in FIG. 1) from the strip 32. As shown in the drawings, in this instance each of the parts 36 bear the image 38 of an "X". The image bearing parts 36 are generally rectangular but taper generally inwardly away from the strip 32. Four cuts 40 extend into the image bearing parts 36 parallel to the sides of the strips 32 and a short distance therefrom, to facilitate flexing of the image bearing parts 36 relative to the strip 30.

A second guide member 42 is provided on the opposite side of the carrying member 30 to the first guide member 26. The first and second guide members 26, 42 are essentially identical. The convex ends 28 of the first and second guide members 26, 42 correspond generally to the convex end 34 of the rectangular strip 32.

A shield member 44 is provided which includes a rectangular frame 46 which extends wholly around just inside the perimeter of the first frame member 12, save for a gap 48 which corresponds to the gap at the right hand edge as shown in FIG. 1 between the rectangular frame sections 22, of the first support member 20. A pair of rectangular shield parts 50, 52 are provided within the frame 46, joined by a web 54 respectively to an upper part of the frame 46 midway along its length, or a lower part of the frame 46.

Inclined leading edges are provided on the left hand and right hand ends of the shield parts 50, 52 as shown in FIG. 1, and the edges are defined by folds 56. As shown in FIG. 1, upwardly inclined leading edges 58 are provided on the left hand end of the upper shield part 50 and the right hand end of the lower shield part 52, and downwardly inclined edges 60 are provided at the right hand end of the upper shield part 50 and the left hand end of the lower shield part 52.

Beneath the shield part 44 as shown in FIG. 2 is a second support member 62 and a second frame member 64. The second support member 62 and second frame member 64 are essentially identical and correspondingly aligned with the first support member 20 and first frame member 12.

The display arrangement 10 is assembled as follows. The first and second guide members 26, 42 are aligned with and glued to the rectangular strip 32.

The various other components of the arrangement 10 can be glued together as required, whilst permitting the carrying member 30 and the first and second guide members 26, 42 to be slid relative to the other components, with the image bearing parts being able to pass above or below the shield parts 50, 52. When assembled, the first and second guide members 26, 42 locate in the gaps 23 defined between the rectangular frame sections 22 of the first and second support members 20, 62 respectively. The location of the guide members 26, 42 in the gaps 23 guides the movement of the carrying member 30 relative to the frame member 12. The guide members 26, 42 also serve to stiffen and strengthen the rectangular strip 32 of the carrying member 30.

Figure 3C:
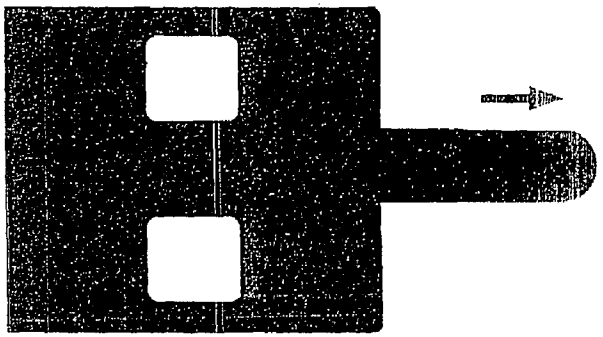
FIGS. 3A to 3F are respectively diagrammatic sequential plan views illustrating operation of the display arrangement of FIG. 1.
Figure 3D:
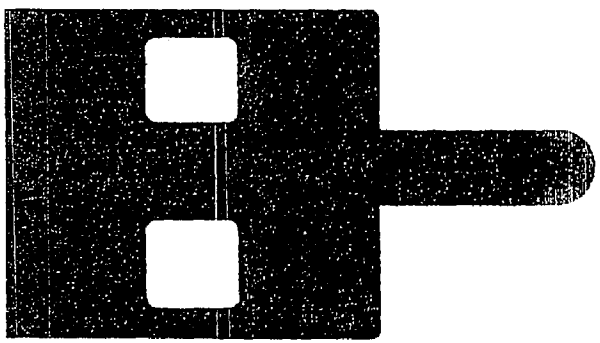
Figure 3B:
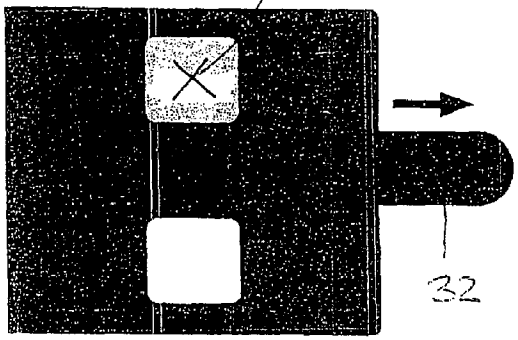
Figure 3E:
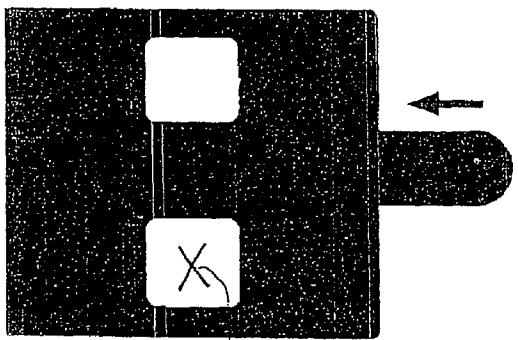
Figure 3A:
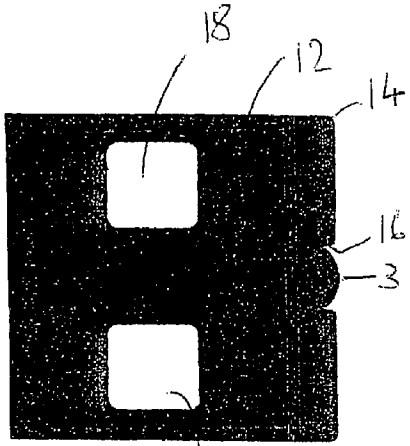
Figure 3F:
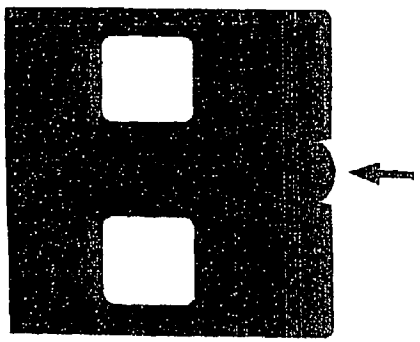

FIGS. 3A to 3F shows sequential operation of the display arrangement 10. In FIG. 3A the carrying member 30 is pushed fully to the left with the tab 34 accessible in the recess 16. The image bearing parts 36 will both be towards the left hand end of the arrangement 10. The tab 34 is now pulled part way to the right so the position shown in FIG. 3B. As the carrying member 30 moves to the right, the top most image bearing part 36 rides up over the upwardly inclined edge 58 to pass over the upper shield part 50 and hence to be visible through the upper window 18. The lower image bearing part 36 is though guided by the downwardly extending edge 60 to pass beneath the lower shield part 52 and hence not be visible through the lower window 18 in the first frame member 12. Any image on the underside of the lower image bearing part 36 will of course be visible through the lower window 18 in the second frame member 64.

The carrying member 30 will then be moved further to the right as shown in FIG. 3C such that both the image bearing parts 36 move over to the right beyond the upper and lower shield parts 52. The carrying member 30 is then moved back to the left as shown in FIGS. 3D and 3E. In this instance the upper image bearing part 36 will pass beneath the upper shield part 50 by virtue of the downwardly extending edge 60 of the right hand end of the upper shield part 50. In contrast the lower image bearing part 36 will pass above the lower shield part 52 and hence the image 38 thereon will be visible through the lowermost window 18 in the first frame member 12. The opposite position will take place in relation to the images on the underside of the image bearing parts 36 and hence at this point the image on the underside of the upper image bearing part 36 will be visible through the upper window 18 in the second frame member 64. The carrying member 30 will be further moved to the left to the position shown in FIG. 3F, and the image bearing parts will move clear to the left hand side of the upper and lower shield part 50, 52. This process can obviously be continuously repeated.

With the arrangement 10, the impression will be given that the image of the "X" moves from the upper window 18 in the first frame member 12 to the lower window 18, and then back to the upper window 18. A similar pattern will be visible through the second frame member 64. Whilst in this arrangement identical images 38 are provided on the two image bearing parts 36, it could be that an altered image is provided on one of the image bearing parts 36 to provide the appearance that something happens to the image as it appears to move between the windows 18. This alteration could for example relate to the movement of the image of a person providing an illusion of the person moving. Alternatively different images could be provided to provide a general flashing effect.

The arrangement therefore provides a novel and unusual effect whilst having a relatively straightforward construction. Therefore the arrangement can be inexpensively and robustly manufactured using conventional book forming techniques.

It is to be realised that a number of modifications may be made without departing from the scope of the invention. As indicated above, different images and variations of images can be provided. It may be that only one frame member is required, and images cannot be seen on the opposite side of the page. It may also be that only one window, or perhaps more than two windows would be used to provide a required effect. Whilst the arrangement has been described in relation to a board book this arrangement could be used in a wide variety of applications. Whilst sliding movement of the carrying member has been described, it would be possible to have an arrangement where the carrying member is rotatable relative to the frame member or members.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

The invention claimed is:

1. A display comprising:

a frame member defining a pair of windows, a carrying member including two image bearing parts, the carrying member being movable relative to the frame member such that each of said images can be moved past a respective one of the windows to be visible therethrough, and a pair of shield members for the windows respectively, the shield members being arranged such that if the respective image bearing part is moved past the respective window in one direction the image passes between the shield member and the window and can be seen through the window, but if the respective image bearing part is moved past the respective window in an opposite direction the image passes on the opposite side of the respective shield member and is thus obscured by the respective shield member and cannot be seen through the respective window, the arrangement being configured such that when moving in a first direction one of the image bearing parts passes between the respective shield member and window to be visible, and the other image bearing part is obscured by the respective shield member, and when moving in the opposite direction said one image bearing part is obscured by the respective shield member, and the other image bearing part passes between the respective shield member and window to be visible.

2. An arrangement according to claim 1, in which inclined flaps are provided on opposite leading edges of the shield members, which flaps are configured to direct the respective image bearing part of the carrying member between the respective shield member and the respective window when reaching the respective shield member moving in a respective one direction, and to direct the respective image bearing part of the carrying member on the opposite side of the respective shield member to the respective window when reaching the respective shield member moving in the respective opposite direction.

3. An arrangement according to claim 1, in which the carrying member includes a tab which is manually engageable to enable a person to move the carrying member relative to the frame member.

4. An arrangement according to claim 1, in which the carrying member is slidably movable relative to the frame member.

5. An arrangement according to claim 1, in which the carrying member is rotatably movable relative to the frame member.

6. An arrangement according to claim 1, in which the display arrangement is in the form of a page of a book.

7. An arrangement according to claim 6, in which the frame member forms one face of the page.

8. An arrangement according to claim 1, in which the display arrangement comprises a plurality of components made from a subsantially planar material.

9. An arrangement according to claim 8, in which the planar material, is paperboard.

10. An arrangement according to claim 1, in which spacer means are provided between the carrying member and the frame member to permit the image bearing parts to move or flex to pass respectively either side of the respective shield member.

11. An arrangement according to claim 1, in which the two images on the respective image bearing parts are identical to provide an illusion of the image moving between the windows.

12. An arrangement according to claim 1, in which one of the images on a respective image bearing part is an altered version of the other to provide an illusion of the image being altered between the windows.

13. An arrangement according to claim 1, in which two different images are provided on the respective image bearing parts.

14. An arrangement according to claim 1, in which the arrangement includes a second frame member with a pair of windows, with the second frame member on an opposite side of the shield members to the first frame member, further images being provided on the opposite side of the image bearing parts of the carrier member, with the further images respectively viewable through the respective windows of the second frame member when the image bearing parts are moved past said respective windows.

* * * * *